United States Patent [19]

Shino et al.

[11] Patent Number: 4,660,820

[45] Date of Patent: Apr. 28, 1987

[54] PAPER FEEDING APPARATUS FOR A COPYING MACHINE/PRINTER

[75] Inventors: Satoshi Shino; Akira Sasahara; Kiyoshi Ishikawa; Shigeru Shibasaki; Shinki Takashina, all of Kanagawa, Japan

[73] Assignee: Xerox Corporation, Stamford, Conn.

[21] Appl. No.: 647,305

[22] Filed: Sep. 4, 1984

[51] Int. Cl.[4] ..... B65H 3/44

[52] U.S. Cl. ..... 271/9; 271/117; 271/158; 271/162

[58] Field of Search ..... 271/9, 157, 158, 159, 271/162, 145, 147, 117

[56] References Cited

U.S. PATENT DOCUMENTS

| | | | |
|---|---|---|---|
| 3,415,508 | 12/1968 | Conti | 271/9 |
| 3,622,238 | 11/1971 | Alman, Jr. et al. | 355/50 |
| 3,659,837 | 5/1972 | Umahashi | 271/9 |
| 3,753,560 | 8/1973 | Kapral et al. | 271/9 |
| 3,756,586 | 9/1973 | Craft | 217/9 |
| 3,936,042 | 2/1976 | Smith et al. | 271/9 |
| 4,165,069 | 8/1979 | Colglazier et al. | 271/162 |
| 4,305,655 | 12/1981 | Gamblin et al. | 271/3.1 |
| 4,350,439 | 9/1982 | Tanioka et al. | 271/227 |

FOREIGN PATENT DOCUMENTS

| | | |
|---|---|---|
| 2826394 | 12/1979 | Fed. Rep. of Germany . |
| 3219784A1 | 12/1982 | Fed. Rep. of Germany . |
| 912215 | 12/1962 | United Kingdom . |

OTHER PUBLICATIONS

IBM Technical Disclosure Bull., "Sheet Feed Dual--Tray Drive" R. D. Mathews, vol. 23, No. 3, Aug. 1980, pp. 870–873.

*Primary Examiner*—Richard A. Schacher

*Attorney, Agent, or Firm*—William A. Henry, II

[57] ABSTRACT

A modular sheet feeding apparatus for connection to a copying machine is disclosed in which a series of tables are mounted as a group and individually positioned for sheet feeding into a copier main frame. The modular apparatus can either include its own feed rolls for each table or use one feed roll that is mounted within the main frame to be moved into and out of sheet feeding position.

1 Claim, 8 Drawing Figures

PAPER FEEDING APPARATUS FOR A COPYING MACHINE/PRINTER

BACKGROUND OF THE INVENTION

This invention relates to a paper feeding apparatus for a copying machine and more particularly to a paper feeding apparatus that is capable of feeding sheets from multiple cassettes to a copying machine or printer.

Conventionally, some copying machines are equipped with a paper feeding apparatus that includes a number of cassettes that are individually loaded into the copiers. Feed rolls are contained within the copiers above each cassette loading position and adapted to feed sheets from a selected cassette upon actuation. Chutes for each cassette are provided for directing sheets from the cassettes and into a converging point and a feed roll that transports the sheets for processing within the copiers.

Problems with this approach to feeding paper to a copier are that too much space is required for the chutes and feed rolls and their associated machinery, jams are tough to get at, storage space is required for additional cassettes, and the machines are limited by the number and size of cassettes available. Accordingly, to overcome these problems there is provided a paper feed apparatus for a copying machine that includes a wide variety of cassettes while allowing the maintaining of small machine sizes and ease of jam removal.

SUMMARY OF THE INVENTION

In accordance with one aspect of the present invention, a paper feeding apparatus is disclosed that includes a plurality of paper feed tables, paper feed rolls respectively disposed on the paper feed tables one each, means for holding the paper feed tables and paper feed rolls at predetermined intervals and parallel to one another, means for moving the holding means up and down, a paper feed unit frame to which the moving means is fixed and means for detecting the position relationship between the paper feed unit frame and the paper feed tables.

In a second aspect, the present invention provides a paper feed apparatus including a plurality of paper feed tables, a paper feed roll apparatus including a plurality of paper feed tables, a paper feed roll respectively disposed to feed paper from the tables, a paper feed unit frame for holding the paper feed tables, means for moving the paper feed unit up and down and means for detecting the position relationship between the paper feed unit frame and paper feed table.

DETAILED DESCRIPTION OF PREFERRED EMBODIMENTS

Figure 1:
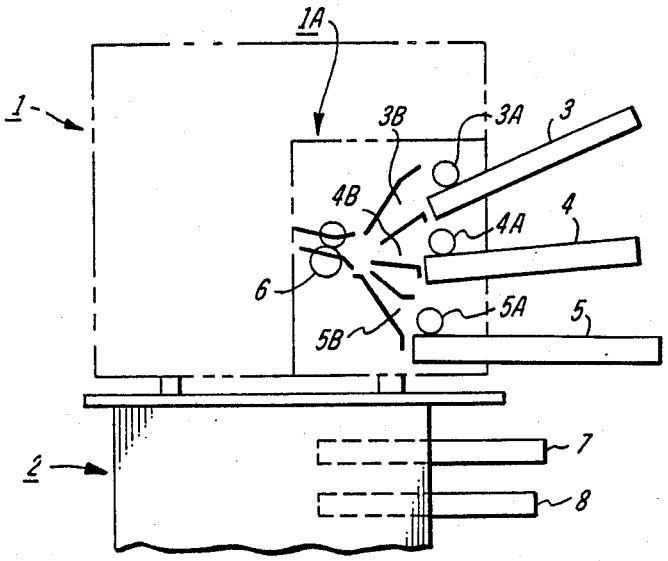
PRIOR ART FIG. 1
FIG. 1 is a schematic diagram of conventional paper feed apparatus.

While the present invention will be described hereinafter in connection with preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

In the drawings, like reference numerals have been used throughout to designate identical elements and the term paper is used herein to include all forms of substrates, e.g., transparencies.

A conventional paper feed apparatus for a copying machine is shown in FIG. 1. In the drawing, the numeral 1 is a copying machine main body, the numeral 2 is a cabinet. The copying machine main body 1 is provided with a paper feed apparatus 1A on which a plurality of cassettes can be loaded, as shown in the drawing. In this example, three cassettes 3, 4 and 5 are shown in feeding position. Feed rolls 3*a*, 4*a* and 5*a* are fixed on the copying machine main body corresponding to each loading position of the above cassettes. Chutes 3*b*, 4*b* and 5*b* are mounted corresponding to the described feed rolls 3*a*, 4*a* and 5*a*. A roll 6 for feeding a transported copy sheet into a transport path of the copying machine main body is disposed on the junction of respective chutes 3*b*, 4*b*, 5*b*.

Spare cassettes 7, 8 are on standby in the cabinet 2. The thus constructed conventional apparatus has disadvantages in that as paper transport paths such as a chute extending from each cassette loading position to the junction thereof are formed as described above, large space is required and when a paper jam is caused between the feed roll 3*a*, 4*a*, 5*a* and the described rolls 6, it is difficult to remove the jammed paper. Conventional machines of this type also have disadvantages in that although multiple cassettes are used, the machines are limited in the number of cassettes that can be positioned therein by the size of the machines. Also, it becomes troublesome to replace a cassette with spare cassettes when sheets of various sizes are frequently used.

Figure 2:
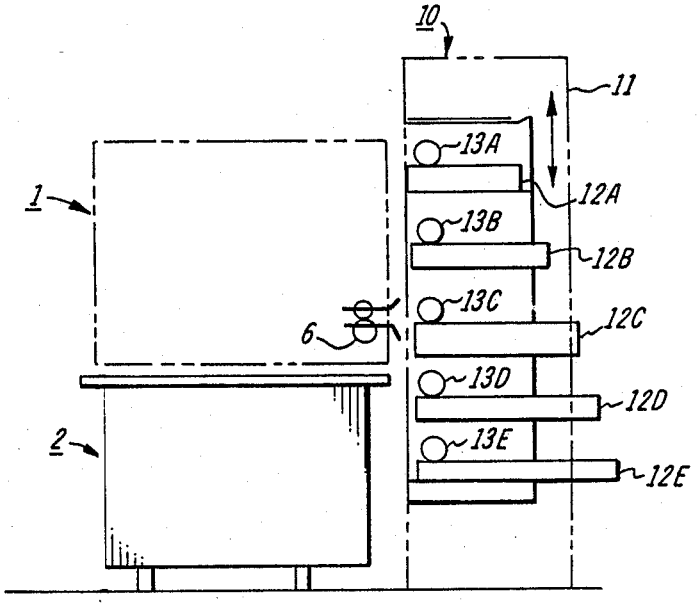
FIG. 2 is a schematic diagram of one embodiment of the present invention.

To alleviate these problems, one embodiment of the present invention is shown in FIG. 2. In the drawing, the numerals 1, 2 respectively show a copying machine main body and a cabinet similar to those of FIG. 1. The numeral 10 is a paper feed apparatus of this invention, and 11 is a paper feed unit frame. In the paper feed unit frame 11, several paper feed tables are disposed, and a plurality of cassettes 12*a*–12*e* are placed on the tables. Paper feed rolls 13*a*–13*e* are mounted corresponding to the respective paper feed tables. These paper feed tables are capable of moving up and down, so that a selected cassette is stopped in a position opposed to the roll 6.

Figure 3:
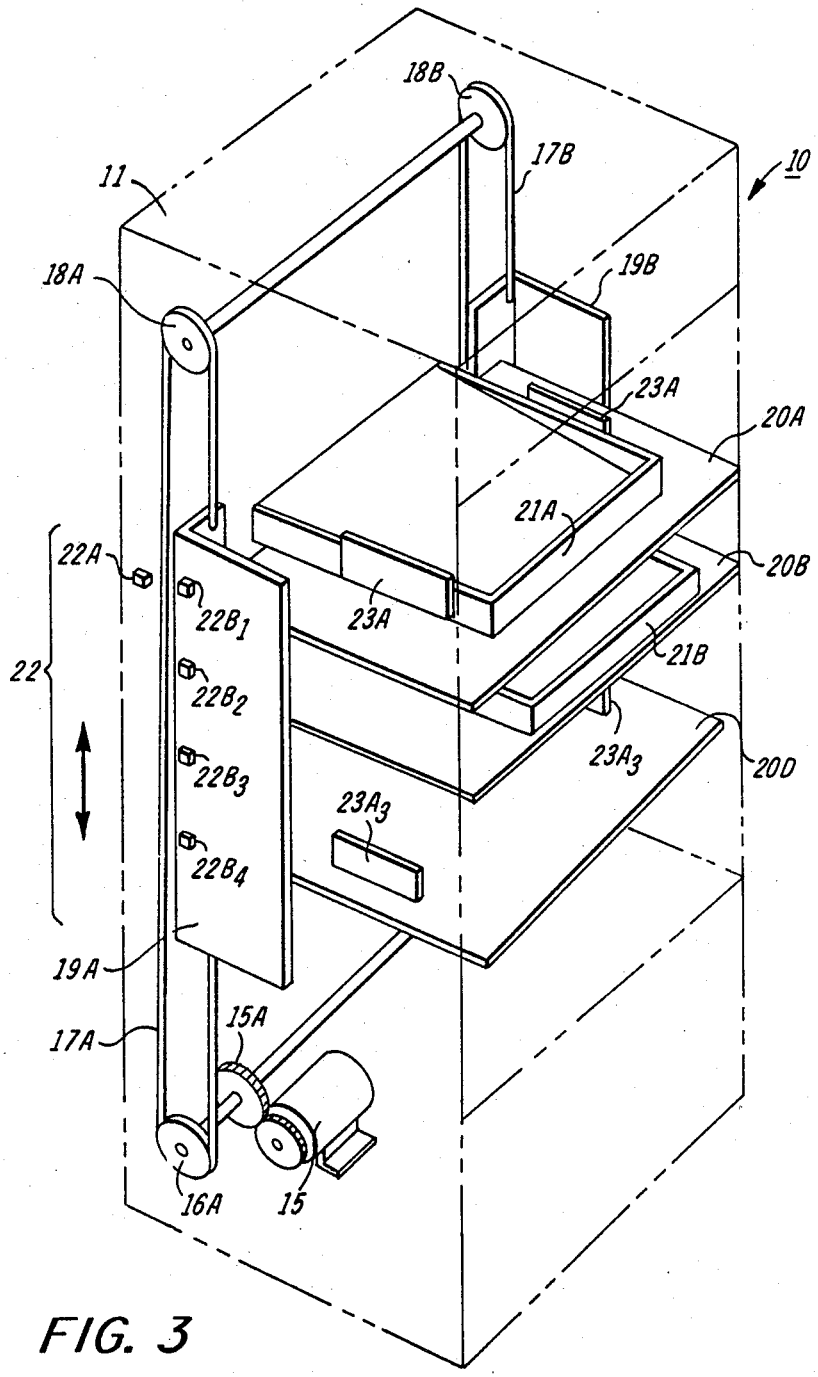
FIG. 3 is a partial perspective view of the embodiment of the invention in FIG. 2.

The paper feed apparatus 10 will now be described in detail with reference to FIG. 3. FIG. 3 is a perspective view of the paper feed apparatus 10. The first pulleys 16*a*, 16*b* (not shown) to which power is applied from a motor 15 and the second pulleys 18*a*, 18*b* to which power is transmitted from the first pulleys 16*a*, 16*b* through belts 17*a*, 17*b* are mounted on the upper and lower portions of the paper feed unit frame 11. Support means 19*a* and 19*b* are respectively fastened on the belts 17*a*, 17*b*, and a plurality of paper feed tables 10*a*–20*d* are mounted between the support means 19*a* and 19*b* level with the paper feed unit frame. Paper feed rolls 13*a*, 13*b* which are opposed to cassettes 21*a*, 21*b* are placed on each of the paper feed tables 20*a*–20*d* and are stretched between the support means 19*a* and 19*b*. Cassette position control members 23*a*–23*a*$_3$ are secured to respective paper feed tables 20*a*–20*d*.

A sensor comprising a lead switch and a magnet piece or sensor 22 such as a photo sensor or the like is fixed on the paper feed unit frame and the support means 19*a*. Here, in view of description, the numeral 22*a* is a magnet piece, and the numerals 22*b*$_1$–22*b*$_4$ are respectively fixed on predetermined places one each corresponding to the cassettes 21*a*–21*d*.

In the thus constructed paper feed apparatus, in this initial state, the lead switch 22*b*$_1$ is opposed to the magnet piece 22*a*. That is, as a reference position, selected is the state that the lead switch 22*b*$_1$ is turned on.

In case of selecting the second stage cassette 21*b*, for example, the motor 15 is operted to move up the support means 19*a* and 19*b*, so that the cassettes 21*a*, 21*b* are lifted up. The motor 15 is stopped when he lead switch 22*b*$_2$ comes to a position opposed to the magnet piece 22*a* and the lead switch 22*b*$_2$ is turned on. Thus, the selected cassette 21*b* is stopped in a position opposed to a paper transport path disposed in the copying machine main body 1. After that, paper is fed out sheet by sheet from the cassette 21*b* to the paper transport path. This operation is conducted by rotating a shaft piercing the paper feed roll 13*b* by a motor not shown.

In a fixed time (for example, 60 seconds) after the paper feeding operation is completed, the motor is reversed to lower the paper feed unit until the lead switch 22*b*$_1$ is turned on, so that the paper feed apparatus is located in a reference position to be on standby.

It will be apparent that the other cassettes may be selected in the same manner as described above.

In the above embodiment, the power of the motor 15 is transmitted to the paper feed table by pulleys and belts. Gears and chains may be substituted for the pulleys and belts if desired.

Though the numeral 22*a* is a magnet piece and the numerals 22*b*$_1$–22*b*$_4$ are lead switches in FIG. 3, it may be desirable that the numeral 22*a* is a lead switch and the numerals 22*b*$_1$–22*b*$_4$ are magnet pieces. In this case, the position where the lead switch 22*a* and the magnet piece 22*b*$_1$ are opposed to each other is a reference position, and when the paper feed table is moved up, which paper feed table is opposed to the transport path is detected from the number of times when the lead switch 22*a* is turned on.

Figure 4:
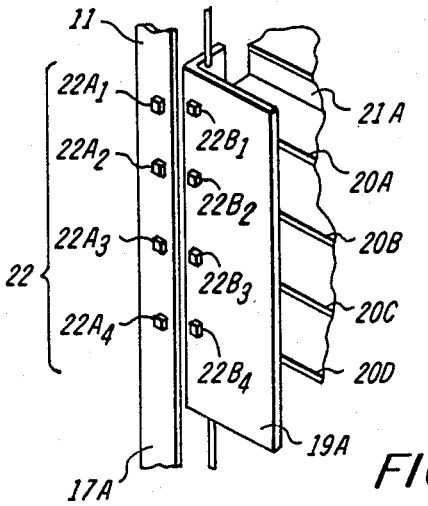
FIG. 4 shows an alternative sensor arrangement to be employed with the apparatus of the present invention.

An alternative to the just disclosed sensor arrangement of this invention will now be described with reference to FIG. 4. FIG. 4 is a perspective view showing only the vicinity of the support means 19*a* of FIG. 3. The portion not illustrated is similar or equal to FIG. 3.

The difference between this sensor arrangement and the described first sensor arrangement is that magnet pieces 22*a*$_1$–22*a*$_4$ are the same in number as the paper feed tables 20*a*–10*d* for cassettes mounted on the paper feed unit frame 11.

It will be understood that in accordance with the present embodiment, when the four lead switches 22*b*$_1$–22*b*$_4$ are turned on together, the cassette 21*a* on the paper feed table 20*a* is in the transport path position. When the lead switch 22*b*$_1$ is off and the lead switches 22*b*$_2$–22*b*$_4$ are on, the cassette on the paper feed table 20*b* is in the transport path position. Similarly, when the lead switches 22*b*$_1$, 22*b*$_2$ are off and the lead switches 22*b*$_3$, 22*b*$_4$ are on, the cassette on the paper feed table 20*c* is in the transport path position, and when the lead switches 22*b*$_1$–22*b*$_3$ are off and only the lead switch 22*b*$_4$ is on, the cassette on the paper feed table 20*d* in the transport path position.

Figure 5:
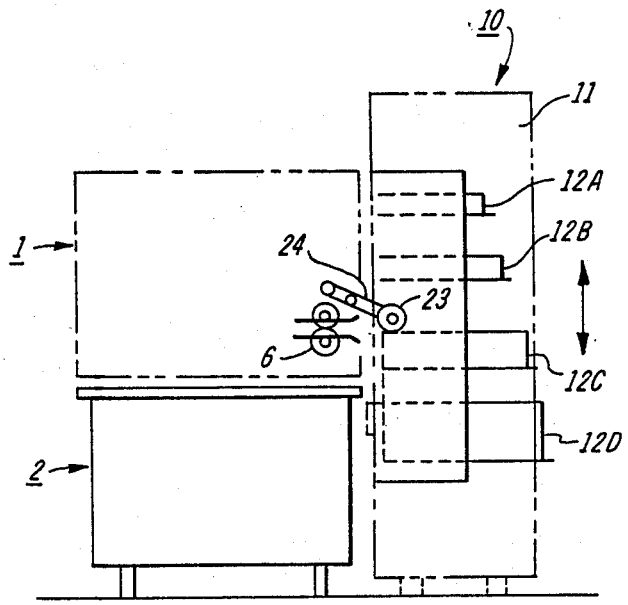
FIG. 5 is a schematic diagram of another embodiment of the present invention.

In another embodiment of the present invention as shown in FIG. 5, a paper feed apparatus is shown in which a wide vareity of cassettes are available even if the copying machine main body is small, an arbitrary number of sheets can be set in one cassette, and only one paper feed roll is required. In the drawing, the numerals 1, 2, 10 and 11 represent elements identical in most respects to those described in reference to FIG. 2. In the paper feed unit frame 11, a number of paper feed tables are supported at arbitrary positions by a means such as disclosed in FIG. 3. A plurality of cassettes 12*a*–12*d* are placed on the feed tables. The tables are capable of moving up and down as described in reference to FIG. 3 and support means 19*a*, so that a selected cassette is stopped at a position opposed to transport roll 6.

In a departure from the disclosure of FIG. 2, the copying machine main body in FIG. 5 is provided with a paper feed roll 23 and a bracket 24 for positioning the feed roll into and out of feed position.

It should be apparent that the other cassettes can be selected in the same manner as described above in reference to FIGS. 3 and 4.

Figure 6:
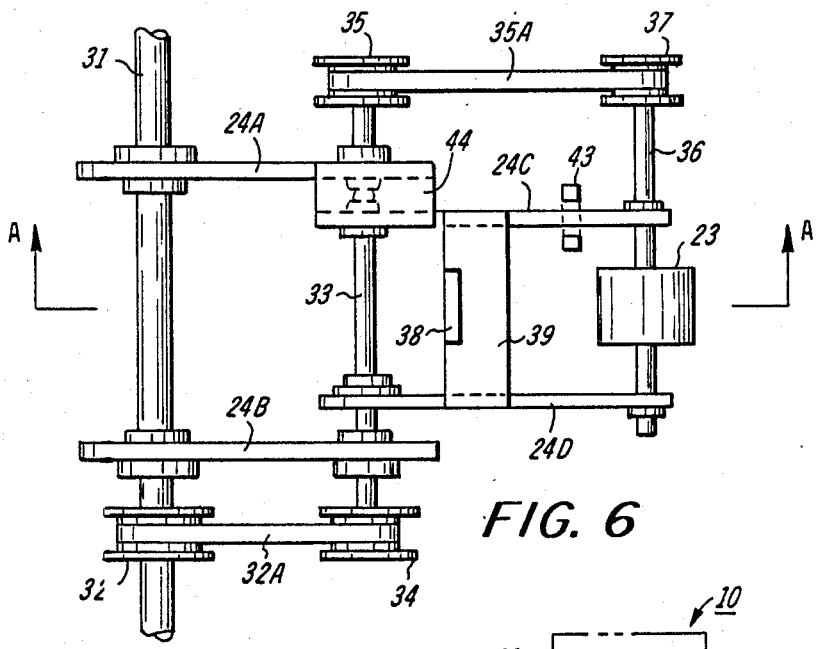
FIG. 6 is a detailed plan view of a mechanism for positioning a paper feed roll.
Figure 7:
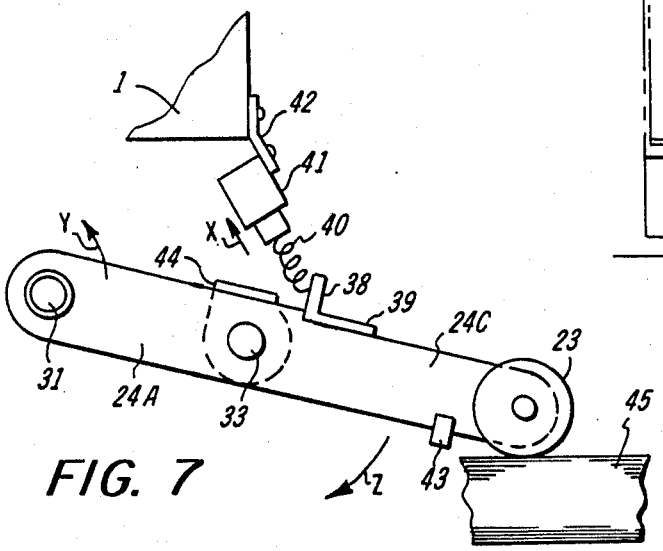
FIG. 7 shows a sectional view taken along lines A—A of FIG. 6 and a schematic diagram of its peripheral apparatus.

The paper feed roll 23, the bracket 24 for locating the paper feed roll in and out of feeding position and its peripheral mechanisms will now be described with reference to FIGS. 6 and 7. FIG. 6 is a detailed plan view, and FIG. 7 shows a sectional view taken along lines A—A of FIG. 6 and its peripheral apparatus.

The first pulley 32 is fixed on a rotary shaft 31 rotatably supported on the copying machine main body 1. The first and second brackets 24*a*, 24*b* are supported on the rotary shaft 31 in such a manner as to be pivotal at each one end thereof. The respective other ends of the first and second brackets 24*a*, 24*b* are pivotally supported on the first shaft 33. The third and fourth brackets 24*c*, 24*d* are supported on the first shaft 33 in such a manner as to pivot on each one end thereof. The second pulley 34 opposed to the first pulley 32 and the third pulley 35 are fixed on the first shaft. The first timing belt 32*a* is stretched between the first pulley 32 and the second pulley 34.

The second shaft 6 is rotatably supported on the other ends of the third and fourth brackets 24*c*, 24*d*. The paper feed roll 23 is fixed on the second shaft 36, and the fourth pulley 37 is fixed thereon at a position opposed to the third pulley 35. The second timing belt 35*a* is stretched between the third pulley 35 and the fourth pulley 37.

A bridge-like member 39 having a projecting portion 38 is disposed between the third and fourth brackets 24*c* and 24*d*. The projecting portion 38 is engaged with a solenoid 41, for example, through a spring 40, as shown in FIG. 7. The solenoid 41 is fixed on the copying machine main body 1 by a fixing member 42. A sensor 43 comprising a photo coupler is disposed below the third bracket 24*c*. A stopper 44 is fixed on the third bracket 24*c*.

In the present embodiment, while the described paper feed tables and the cassettes are placed on the paper feed tables and are moved up and down, the solenoid 41 is excited, so that the third bracket 24*c* is pulled in the direction of an arrow X through the projecting portion 38 of the bridge-like member 39, which causes the first bracket 24*a* to turn in the direction of an arrow Y, and causes the second bracket 24*c* to turn in the direction of an arrow Z. That is, the paper feed roll 23 is retreated from the paper feed tables so that these paper feed tables can move up and down.

When the cassette enclosing paper of desired size is stopped at a position opposed to the paper transport path mounted on the copying machine main body 1 as described above, the excitation of the solenoid 41 is released. As a reult, the third bracket 24*c* is pushed in the opposite direction to the arrow X direction through the spring 40, the projecting portion 38 and the bridge-like member 39. Therefore, the first bracket 24*a* and the third bracket 24*c* are respectively turned in the directions opposite to the arrow Y and the arrow Z. This movement is stopped by the stopper 44 when the first and third brackets 24*a* and 24*c* are aligned as shown in FIG. 7.

With the first and third brackets 24*a* and 24*c* aligned, the paper feed roll 23 is positioned on copy paper 45 to press the copy paper with proper force.

The sensor 43 is adapted to judge whether the copy paper 45 is located in the proper position for the paper transport path mounted in the copying machine main body 1 or not. If the copy paper 45 is positioned to high, the third bracket 24*c* is moved above to go outside the sensor 43. Alternatively, if the copy paper 45 is positioned too low, the bracket is moved down toward the sensor 43.

In case of feeding paper, the rotary shaft 31 is rotated in a suitable timing by a motor not shown, whereupon the rotation is transmitted to the paper feed roll 23 through the first timing belt 32*a* and the second timing belt 35*a*.

At the time of reversing the motor 15 after the completion of feeding paper to return the paper feed apparatus to the reference position, the solenoid 41 is again excited to remove the paper feed roll 23 from its feeding position so as to not disturb the movement of the paper feed tables 20*a*, 20*b*, etc.

Figure 8:
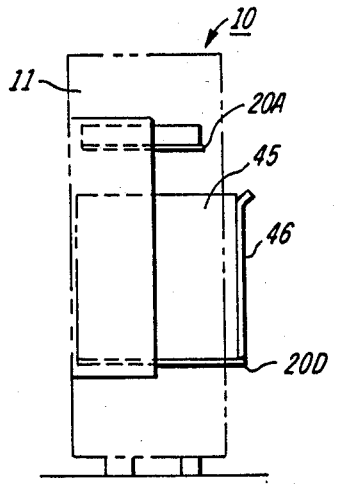
FIG. 8 is a schematic diagram showing one method of using the paper feed apparatus of FIG. 5.

FIG. 8 is a elevational view showing one method for using the paper feed apparatus 10. Since the paper feed roll 23 is provided on the copying machine main body 1 in the described embodiment of this invention in FIG. 5, the paper feed tables fixed on the paper feed unit frame 11 can be attached and detached. Therefore, in a case of using a large quantity of paper of specified size, as shown in FIG. 8, the second stage and third stage paper feed tables are detached to leave only the fourth stage paper feed table 20*d*, so that a cassette 46 where a large quantity of paper 45 is stacked can be loaded on the fourth stage paper feed table 20*d*.

It should now be apparent that a paper feed apparatus has been disclosed that answers the above-mentioned shortcomings of the conventional copiers by providing a multiple cassette modular separate paper feed source for connection with paper path of a copier. The separate source can either have feed roll for each cassette or have one feed roll attached to the frame of the copier for feeding sheets from cassettes positioned adjacent to it.

In addition to the apparatus disclosed above, other modifications and/or additions will readily appear to those skilled in the art upon reading this disclosure and are intended to be encompassed within the invention disclosed and claimed herein.

What is claimed is:

1. A modular sheet feeding unit adapted to feed sheets to a printer for processing, comprising:

sheet feeding unit frame means adapted for connection or disconnection in relation to sheet transport means located within said printer at one edge thereof to feed sheets through an opening in one end of the enclosure of said printer to said sheet transport means;

a plurality of tables moveably supported at arbitrary positions within said sheet feeding unit frame means;

sensor means adapted to control the positioning of said tables;

a plurality of cassettes adapted for positioning on said tables; and dual positioning feed means mounted within said printer at said one edge thereof for feeding sheets from said cassettes to said transport means, said dual positioning feed means being adapted when in a first position to extend outside said printer and act as the sole means for feeding sheets from said plurality of cassettes as they are individually positioned adjacent said sheet transport means by said sensor means and when in a second position to be withdrawn from said first position to a location inside said printer.

* * * * *

UNITED STATES PATENT AND TRADEMARK OFFICE

CERTIFICATE OF CORRECTION

PATENT NO. : 4,660,820

DATED : April 28, 1987

INVENTOR(S) : Satoshi Shino, et al

It is certified that error appears in the above-identified patent and that said Letters Patent are hereby corrected as shown below:

Title page, Inventors:

In Block 75, "shinki" should read --shinji--

Signed and Sealed this

Twenty-sixth Day of January, 1988

*Attest:*

DONALD J. QUIGG

*Attesting Officer*

*Commissioner of Patents and Trademarks*